United States Patent [19]

Conlin

[11] Patent Number: 4,721,127

[45] Date of Patent: Jan. 26, 1988

[54] METHOD AND APPARATUS FOR UNDERGROUND TANK CLEANING

[76] Inventor: Carter B. Conlin, 820 Gessner, Suite 1010, Houston, Tex. 77024

[21] Appl. No.: 897,143

[22] Filed: Aug. 15, 1986

[51] Int. Cl.[4] ..... B08B 9/12

[52] U.S. Cl. ..... 137/15; 137/568; 417/442; 15/246.5; 134/21

[58] Field of Search ..... 137/15, 565, 568, 569; 417/435, 440, 442; 166/311; 15/1.7, 104.3 R, 246.5; 134/18, 21, 36

[56] References Cited

U.S. PATENT DOCUMENTS

| | | | |
|---|---|---|---|
| 1,717,812 | 6/1929 | Smith et al. | 417/435 |
| 2,183,351 | 12/1939 | Harris | 417/435 |
| 2,332,940 | 10/1943 | Senke | 15/246.5 X |
| 2,845,091 | 7/1958 | Neer | 15/246.5 X |
| 3,046,163 | 7/1962 | Kearney et al. | 134/11 |
| 3,121,027 | 2/1964 | Galanor | 134/10 |
| 3,183,940 | 5/1965 | Alquist et al. | 15/246.5 X |
| 3,205,828 | 9/1965 | Rupp | 103/103 |
| 3,236,248 | 2/1966 | Ray | 134/58 |
| 3,268,933 | 8/1966 | Marantette et al. | 15/1.7 |
| 3,291,058 | 12/1966 | McFarlin | 103/113 |
| 3,300,983 | 1/1967 | Dougherty et al. | 61/5 |
| 3,341,880 | 9/1967 | Young | 15/257 |
| 3,874,399 | 4/1975 | Ishihara | 137/13 |
| 4,153,553 | 5/1979 | Davis | 210/95 |
| 4,360,436 | 11/1982 | Poveromo | 210/799 |

FOREIGN PATENT DOCUMENTS

| | | | |
|---|---|---|---|
| 2316823 | 10/1974 | Fed. Rep. of Germany | 417/442 |
| 64200 | 5/1980 | Japan | 417/442 |
| 601037 | 4/1978 | U.S.S.R. | 417/442 |

OTHER PUBLICATIONS

"tankleenor TM" brochure, The Gorman-Rupp Company, ©1983.

*Primary Examiner*—Alan Cohan
*Assistant Examiner*—John Rivell
*Attorney, Agent, or Firm*—Arnold, White & Durkee

[57] ABSTRACT

A method and apparatus are disclosed which may be used in removing contaminants from underground petroleum storage tanks. A positive displacement pump and piping manifold are used to withdraw contaminants from an underground tank and pump those contaminants into a receiving drum. A startup suction valve is utilized to control the rate at which withdrawal is initiated and a bypass valve controls the rate of withdrawal from the tank as the cleaning operation is performed. A sample connection at the pump discharge provides means for determining the contaminant-to-product ratio of fluid being withdrawn from the underground tank. The bypass valve may be adjusted to maximize the contaminant-to-product ratio and minimize the loss of petroleum product.

21 Claims, 2 Drawing Figures

METHOD AND APPARATUS FOR UNDERGROUND TANK CLEANING

FIELD OF THE INVENTION

The present invention relates to the removal of contaminants from underground storage tanks containing petroleum products and, in particular, to a method and apparatus for controlling the rate at which contaminants are withdrawn from a tank and for monitoring fluids to determine the ratio of contaminant to petroleum product and minimize the loss of petroleum product.

BACKGROUND OF THE INVENTION

It is common practice in service stations and elsewhere to use underground tanks to store petroleum products. The use of such tanks results in greater space utilization as well as greater safety to operators and the public in general. However, the use also has several drawbacks, which include the need to clean the tanks and to remove contaminants which invade and accumulate in the tanks.

Contaminants such as water and sediment tend to accumulate in the bottom of underground storage tanks after a period of use. In some cases, contaminants may be introduced into a tank along with the petroleum product that is put into the tank. Again, when a product is stored in a tank for a long period of time, sediment may grow in the tank in the form of fungus or algae. Further, sediment in the form of metallic scale or rust may fall into the bottom of a tank from the internal sides of the vessel as a result of oxidation or corrosion. Generally, an accumulation of contaminants in a tank will lower the quality of the product stored in the tank. The water and sediments which accumulate in the bottom of a hydrocarbon storage tank are sometimes referred to as bottom sediment and water.

Removal of water in tanks storing fuels which contain alcohols in especially critical because of the affinity of alcohols to water. If the water is not removed, a phase separation is likely to occur in which the alcohol drops out of the fuel because of its attraction to the water phase. A low octane hydrocarbon phase then remains above the water/alcohol phase.

One popular system ("TANKLEENOR") for removing contaminants from underground storage tanks is manufactured and sold by the Gorman-Rupp Company of Mansfield, Ohio. This system includes a hose reel assembly for extending a suction hose into the underground tank, a centrifugal pump attached to the hose assembly, and an operating/discharge barrel for holding fluid for operation of the centrifugal pump and for receiving fluids or other materials withdrawn from the tank. The hose reel assembly is the same as or similar to that shown in U.S. Pat. No. 3,341,880 and includes a rigid guide tube which extends vertically into the underground tank and reaches the bottom of the tank. A flexible hose is stored on a reel and, when in use, is extended through the guide tube to the bottom of the tank at which point the flexible hose turns approximately 90° and extends along the bottom of the tank. A stiffener on one edge of the flexible hose causes the hose to bend in one direction only and the direction of extension of the hose along the bottom of the tank may thus be controlled.

The centrifugal pump used in the TANKLEENOR system takes suction from the operating fluid (usually water) in the operating/discharge drum and discharges the fluid through an eductor in the pump. This discharge of fluid through the eductor creates a vacuum of approximately 16 to 18 inches mercury. The discharge of the eductor is routed back to the metal drum to be once again used by the pump. The flexible hose extending into the underground tank is connected to the vacuum side of the eductor on the centrifugal pump. The vacuum created by discharge of operating fluid through the eductor causes a suction to be applied to the flexible hose. As contaminant is pulled from the tank bottom, it passes into the eductor and joins the eductor operating fluid which is flowing back to the operating/discharge drum. The drum gradually fills with the mixture of the operating fluid being circulated and the contaminant being removed from the tank bottom.

In the TANKLEENOR system and systems similar thereto, the only means for determining flow and for assessing the appearance of the contaminant is a small sight glass on the hose reel. It is not possible to take a sample of the contaminant, because it is under vacuum until it reaches the eductor where it is then mixed with water or other operating fluid. Moreover, the rate of suction of contaminants or product from the underground storage tank may not be regulated because the vacuum created at the eductor is constant. Also, existing systems generally involve the use of an open drum of fluids which include gasoline or other flammable fuels. Finally, the large size and weight of the centrifugal pump required (commonly, 80 gallons per minute capacity) is disadvantageous.

SUMMARY OF THE INVENTION

An underground tank cleaning system according to the present invention comprises generally a suction hose reel assembly, a positive displacement pump, a receiving drum, and a piping manifold to which the hose, pump and drum are connected. The hose reel assembly is similar to that shown in U.S. Pat. No. 3,341,880 and includes a telescoping guide tube and a hose having a stiffening tape to facilitate the guiding of the hose along a tank bottom. The pump may be a relatively small, low capacity positive displacement pump and is generally capable of producing vacuums in excess of 22 inches mercury when used in conjunction with the piping manifold. The receiving drum initially contains enough fluid to initiate the cleaning system. The drum thereafter receives the contaminants pumped from the underground tank. During normal operation of the system, fluids and contaminants contained in the receiving drum are not recirculated into the pump and manifold system.

A piping manifold includes connections for the tank suction hose, the suction and discharge of the positive displacement pump, a final discharge valve for connection to the receiving drum, a startup valve, and a bypass valve. The bypass valve is used to control the rate at which the pump removes sediment from the underground tank, thus limiting the amount of petroleum product which is removed with the contaminant. The manifold also includes a sample connection from which a sample of the pump discharge may be taken to determine the ratio of contaminant-to-product which is being removed from the underground tank.

DETAILED DESCRIPTION OF A PREFERRED EMBODIMENT

Figure 1:
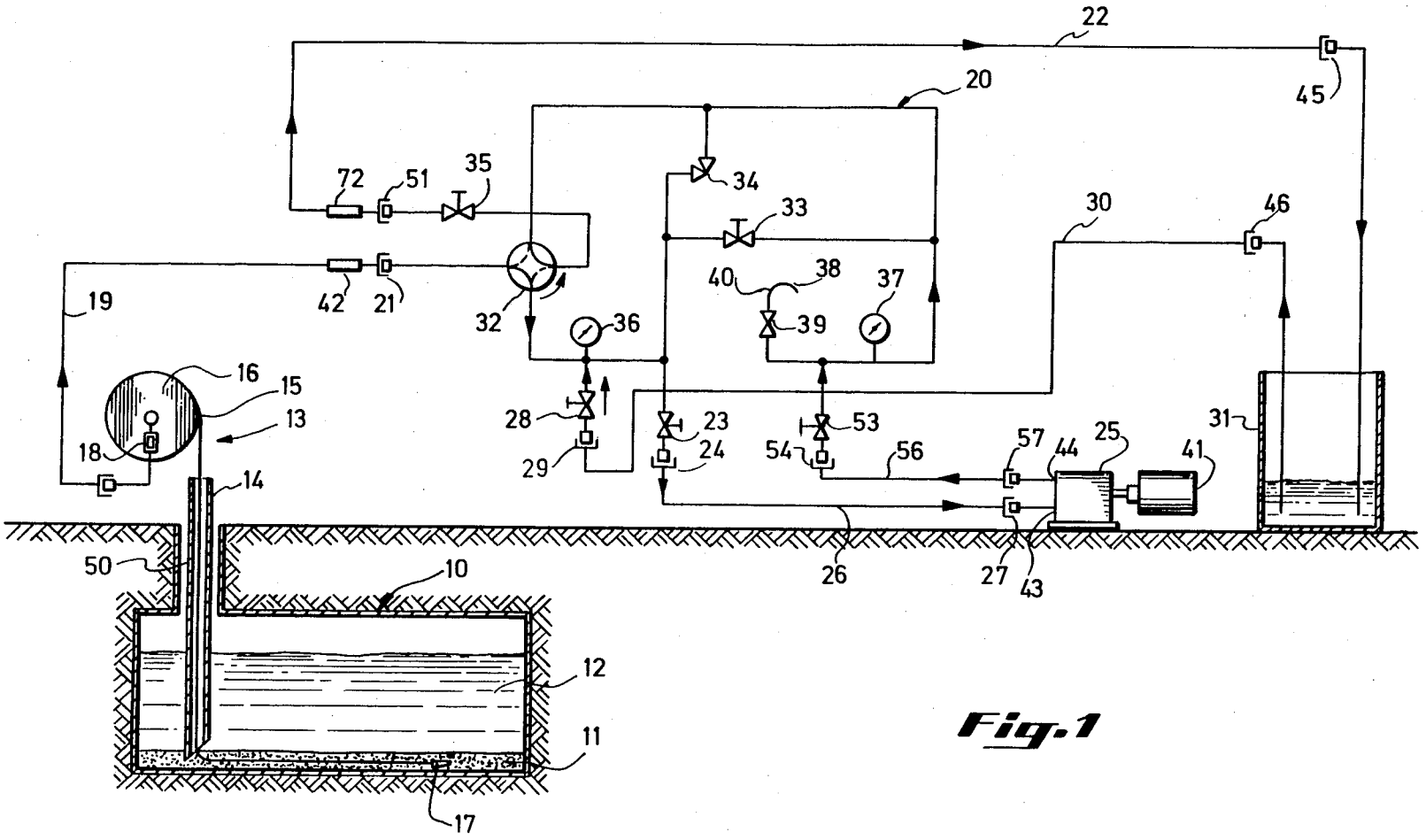
FIG. 1 is a piping schematic illustrating a tank cleaning system utilizing the present invention.

FIG. 1 is a piping schematic illustrating an underground tank cleaning system according to the present invention. An underground tank 10 to be cleaned will contain a bottom layer 11 of bottoms sediment, including water and other fluid or solid contaminants. The petroleum products stored in the tank, being of a lesser density than the bottom sediment, will float on the bottom sediment and constitute an upper layer 12.

A suction hose assembly, indicated generally at 13, includes a relatively rigid guide tube 14, a flexible suction hose 15, and a reel 16 upon which the hose 15 may be wound for storage. A nozzle 17 or other suitable termination may be affixed to the submerged end of the hose 15. A sight glass 18, located at the fixed end of the hose 15, can be used to indicate a flow of fluid or contaminants through the hose 15. The suction hose assembly 13 is similar to that shown in U.S. Pat. No. 3,341,880 and the hose 15 includes a stiffening tape which allows bending of the hose in generally one direction and restricts flexibility in other directions. A manifold intake hose 19 connects the tank suction hose 15 to a manifold assembly 20.

The manifold assembly 20 generally comprises an arrangement of valves, piping, connectors, and indicators. Quick connectors 21 and 51 provide connections to the manifold 20 for a manifold intake line 19 and a discharge line 22. Valves 23 and 53 and quick connectors 24 and 54 provide points of connection for a positive displacement pump 25 via hoses 26 and 56 and connections 27 and 57. A startup suction line 30 is connected to the manifold 20 by means of a quick connector 29 and a startup suction valve 28. The startup suction line 30 and the discharge line 22 terminate on their second ends in a receiving drum 31 as will be more fully explained below.

A four-way valve 32 is included in the manifold 20 and provides communication between the connectors 21 and 51 and the valves 23 and 53. The four-way valve 32 may be placed in one of two positions. In a first position, communication is provided between the manifold intake line 19 and the suction 43 of the pump 25, while communication is also provided between the discharge line 22 and the discharge 44 of the pump 25. In its second position, the four-way valve 32 provides communication between the manifold intake line 19 and the discharge 44 of the pump 25 and communication between the discharge line 22 and the suction 43 of the pump 25. Thus, the pump 25 may cause the flow in the manifold line 19 and the discharge line 22 to be in one of two directions, dependent upon the position of the four-way valve 32.

A bypass valve 33 is also included in the manifold 20 and is located on the manifold side of the valves 23 and 53. The bypass valve 33 connects the pump discharge 44 to the pump suction 43 and provides for recirculation of the pump discharge. A safety valve 34 is connected parallel to the bypass valve 33 and also interconnects the discharge 44 and the suction 43 of the pump 25. The safety valve 34 operates to allow recirculation of the pump discharge 44 into the pump suction 43 in the event that the bypass valve 33 and the final discharge valve 35 are closed at the same time. The final discharge valve 35 is a part of the manifold 20 and is located on the manifold side of the quick connector 51 which interconnects the discharge line 22 with the manifold 20. The discharge valve 35 may be utilized to prevent flow into or out of the discharge line 22.

A vacuum indicator 36 and a pressure indicator 37 are also included in the manifold 20. The vacuum indicator 36 taps into the pump suction side of the manifold 20 intermediate the four-way valve 32 and the pump suction valve 23 and is used to give an operator an indication as to the level of suction provided by the pump 25 on the manifold intake line 19. The pressure indicator 37 taps into the pump discharge side of the manifold 20 intermediate the pump discharge valve 53 and the four-way valve 32 and gives an operator an indication of the level of output of the pump 25. A sample connection 38 is also tapped into the pump discharge side of the manifold 20 and includes a valve 39 and a tubing 40. When it is desired to sample the fluid being pumped by the pump 25, the valve 39 may be opened slightly and a sample may be extracted from the tubing 40. As will be more fully described below, samples will be taken during normal operation of the tank cleaning system to determine when adjustment is required in the rate of suction from the underground tank 10.

Operation of the System

To prepare the system for operation, the guide tube 14 is carefully lowered into the open fill line 50 of the underground tank 10, generally cylindrical in shape, until it rests on the bottom of the tank 10. The hose reel 16 with the hose 15 thereon is mounted atop the guide tube 14 and is fastened thereto with flexible securing pins or other adequate means. The hose reel 16 is rotated until it points in a direction that is parallel with the longitudinal axis of the underground tank 10. This is done to direct the travel of the hose 15 parallel to the longitudinal axis of the underground tank 10. The hose 15 is then inserted into the top of the opening of the guide tube 14 and gradually pushed downward. When the hose 15 reaches the bottom of the tank 10, it will make a right-angle transition from vertical to horizontal and will rest on the tank bottom. Continued feeding of the hose 15 down the guide tube 14 will cause the nozzle 17 to travel parallel to the longitudinal axis of the underground tank 10. The design of the hose 15 will allow travel of the nozzle 17 in generally one line only.

The manifold intake line 19, connected on its one end to the hose 15 at the hose reel 16, is connected to the manifold 20 via the quick connector 21. The discharge line 22 is connected on its one end to the quick connector 51 of the manifold 20 and its other end terminates in a quick connector 45. A cover fits over the top of the receiving drum 31 and a tube or pipe extends through the cover to near the bottom of the drum 31. The quick connector 45 is located at the upper end of the pipe or tube and facilitates connection of the discharge line 22.

The startup suction line 30 is connected on its one end to the connector 29 of the manifold 20, and its second end terminates in a quick connector 46. As in the case of the discharge line 22, a pipe or tube extends through the cover of the drum 31 to near the bottom of the drum 31. The quick connector 46 is located at the upper end of the pipe or tube and facilitates connection of the startup suction line 30. The quick connectors 45 and 46 provide convenient points for connection of the lines 22 and 30 to the pipes or tubes which extend into the drum 31 through its cover. This arrangement facilitates set-up and break-down of the system.

The interconnecting hoses 26 and 56 are used to connect the suction 43 and the discharge 44 of the pump 25 to the manifold 20 via the connectors 24 and 54 and 27 and 57.

To start up and operate the tank cleaning system, a relatively small amount of operating fluid, normally the same type fluid as stored in the tank 10, is put into the receiving drum 31. The pump suction and discharge valves 23 and 53 and the startup suction valve 28, all on the manifold 20, are opened while the bypass valve 33 is closed. The final discharge valve 35 is opened and the four-way valve 32 is placed in its first position, providing communication between the manifold intake line 19 and the suction 43 of the pump 25 and communication between the discharge line 22 and the discharge 44 of the pump 25. The pump 25 is started by starting the pump motor 41 and the startup fluid begins to circulate to and from the receiving drum 31, purging air from the system. Circulation of the startup fluid results from suction of the fluid through the startup line 30 and through the valves 28 and 23 and, then, discharge of the fluid through the valves 53, 32 and 35 and through the discharge line 22.

By slightly opening the bypass valve 33, any air remaining in the bypass is purged from the system. With the bypass valve 33 slightly open, the startup suction valve 28 is gradually closed off until the vacuum indicator 36 indicates a level of vacuum on the pump suction of approximately 18 to 22 inches of mercury. This level of vacuum is maintained to initiate flow from the underground tank 10 through the hose 15 and the manifold intake line 19. The initiation of this flow may be detected by viewing the sight glass 18 and a sight tube 42 located in the manifold intake line 19. When flow from the underground tank 10 has been detected, the startup suction valve 28 is closed completely. The startup fluid in the receiving drum 31 will then no longer be circulated by the pump 25 and the discharge from the pump 25 will consist solely of the flow from the underground tank 10.

A sample of the fluid being withdrawn from the underground tank 10 may be taken from the sample connection 38. This is accomplished by slightly opening the valve 39 and retrieving the sample from the tubing 40. The sample may be evaluated to determine the ratio of contaminant-to-product being withdrawn from the underground tank 10. The bypass valve 33 is adjusted to vary the rate of withdrawal from the underground tank 10. For example, where the depth of aqueous or sedimentary contamination in the underground tank 10 is great, a sample withdrawn from the sample connection 38 will indicate a high ratio of contaminant-to-product being withdrawn from the tank 10. Accordingly, bypass valve 33 will be either closed or only slightly opened to maximize the rate of withdrawal from the underground tank 10 by the pump 25. This maximizing of the flow rate will minimize the length of time required to clean the tank. As the depth of the contaminant on the tank bottom is decreased, this high rate of flow will begin to pull in more of the tank product, which is undesirable. A sample taken from the sample connection 38 will indicate that the ratio of contaminant-to-product has fallen and the bypass valve 33 may be opened more to decrease the rate of withdrawal from the underground tank 10. The decreased flow rate from underground tank 10 will increase the contaminant-to-product ratio, resulting in conservation of valuable petroleum product.

The nozzle 17 of the hose 15 will normally be moved along the bottom of the underground tank 10 by pushing the hose 15 downwards into the guide tube 14 while simultaneously rotating the hose reel 16 to unwind the hose 15. Generally, the entire length of the tank will be swept by moving the nozzle 17 back and forth until the samples taken at the sample connection 38 indicate that all or a major part of the contaminant has been removed.

Should the hose 15 become plugged, as evidenced by decreased or zero flow condition, it generally can be unplugged by backflushing. This is accomplished by rotating the four-way valve 32 from its first normal position to its second position. As discussed above, the pump 25 then reverses the flow in the discharge line 22 and the manifold intake line 19 and, generally, in a few seconds, the hose 15 or the nozzle 17 will be unplugged.

To shut the tank cleaning system down, the hose 15 will be reeled onto the hose reel 16 while the pump 25 continues to run. The bypass valve 33 will be in a partially opened position so as to give the pump 25 fluid to circulate. When the hose 15 has been completely withdrawn from the underground tank 10, the pump 25 will be stopped. The final discharge valve 35 will then be closed to prevent any siphoning of contaminated fluid from the receiving drum 31 back into the underground tank 10.

Figure 2:
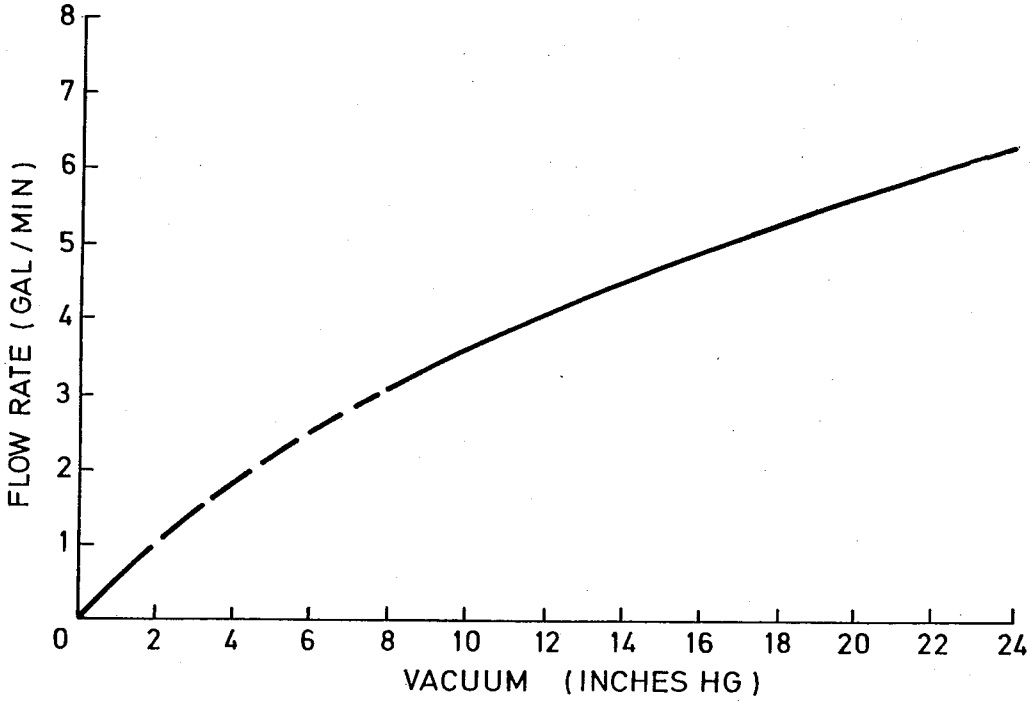
FIG. 2 illustrates the variable flow rate obtainable from a system of the present invention.

FIG. 2 graphically illustrates the relation between the level of vacuum indicated by the vacuum indicator 36 and the rate of flow, in gallons per minute, of contaminants or fluids which may be withdrawn from the underground tank 10. This relationship was obtained empirically using an actual embodiment of the present invention wherein a 15 gallon-per-minute capacity positive displacement pump was utilized. The pump was a Blackmer Model XSF1P, while all manifold piping, valves and interconnecting hoses were ¾ inch diameter.

A manifold and tank cleaning system according to the present invention provides a reliable method for obtaining suction under the most difficult conditions. By taking suction on fluid in the receiving drum with a positive displacement pump and then throttling the startup suction valve on the manifold, the suction vacuum can be increased to the range of 18 to 22 inches mercury and maintained there indefinitely since the fluid is being recirculated. This provides the ability to lift fluid from typical underground service station tanks containing gasoline, even at atmospheric temperatures in the range of 100° to 120° F. At such temperatures, the vapor pressure exerted by the volatile liquid normally makes it difficult to obtain suction from underground tanks.

Furthermore, the rate of flow from the underground tank can be varied at will by adjusting the bypass valve on the manifold. Variation of this flow rate allows control over the contaminant/product ratio in order to minimize removal of product from the underground tank. Excessive removal of product results in either loss of that product or additional handling for separating it from the contaminated fluid by decantation or filtration so that it can be returned to the tank.

In addition, the present apparatus and method allow the pumping of the fluid from the bottom of the underground tank rather than the pumping of a mixture of that fluid and another fluid, such as water or petroleum product, which is used in other systems as a circulating fluid. By pumping the fluid in this method, it is possible to sample the fluid to determine the contaminant/-product ratio and adjust the flow rate accordingly.

It is contemplated that a system according to the present invention is safer to operate than other, conventional tank cleaning systems. Thus, the receiving drum may be located relatively remotely from the underground tank fill line where the hose reel and guide tube assembly are located. Also, a cover for the receiving drum has small openings therein to receive the two hoses, or associated pipes or tubes, with minimal clearance. This cover inhibits undue dispersion of possibly flammable fumes. These features are made possible because of the use of relatively small hoses for transferring fluid to and from the receiving drum. Other tank cleaning systems employ an open top metal drum which is located in the immediate vicinity of the pump, the hose reel guide tube and the fill line of the underground tank; this congestion is caused by the fact that the relatively large diameter hoses used for pump circulation must be limited in length.

Finally, the manifold and pump assembly of the present invention are easily transportable because of the relatively few parts and the small sizes. The positive displacement pump and the hoses and fittings utilized in the present invention are considerably smaller than those of similar systems.

Although the above description describes details of a preferred embodiment of the present invention, it will be understood by those skilled in the art that numerous other embodiments and applications of the invention may exist or may be developed. Although in many such applications, all of the advantages of the illustrated embodiment may not be achieved, certain desirable attributes may be attainable. For example, the rate at which contaminants are pumped from the underground tank may be controlled using the startup suction valve and the bypass valve may be eliminated. By partially opening the startup valve, the suction from the tank will decrease proportionately and, by completely closing the startup valve, the suction from the tank will be maximized. Although the bypass valve can be eliminated, one disadvantage of such an arrangement is that, while the startup valve is open or partially open, a sample taken from the sample connection may not give a true indication of the fluid being withdrawn from the underground tank at that moment. Other variations may also yield certain advantages while suffering from certain disadvantages.

The scope of the present invention should accordingly be limited only by the scope of the appended claims.

What is claimed is:

1. An apparatus for removing contaminants from an underground storage tank, comprising:
- a receiving tank;
- a manifold having a suction valve and a discharge valve;
- a flexible suction hose for insertion into said underground storage tank, said suction hose being connected to said suction valve;
- a positive displacement pump adapted to take suction through said suction valve and to discharge through said discharge valve to said receiving tank; and
- a startup line adapted at one end to take a suction on liquid in said receiving tank and connected at its other end to said manifold,
- the manifold including a valve means for selectively causing said pump to take suction through said discharge valve and causing said pump to discharge through said suction valve.

2. The apparatus of claim 1, further comprising means for varying the rate of suction of said pump through said suction valve.

3. The apparatus of claim 1, wherein said manifold further includes a bypass valve for controllably interconnecting the discharge of said pump and the suction of said pump.

4. An apparatus for removing contaminants from an underground storage tank, comprising:
- a flexible suction hose for insertion into said tank;
- a pump for pumping contaminants from said tank to a receiving drum; and
- a piping manifold for connection between said suction hose and said pump and between said pump and said receiving drum, said manifold having a bypass valve for varying the rate of suction by said pump from said tank and said manifold having a backflush valve means for alternatively connecting a discharge of said pump to said suction hose or to said receiving drum.

5. The apparatus of claim 4, further comprising:
- a startup suction line interconnecting said receiving drum and the suction of said pump; and
- a startup valve interposed in said startup suction line for controlling a level of vacuum at the suction of said pump.

6. An apparatus for removing contaminants from an underground storage tank, comprising:
- a flexible suction hose for insertion into said tank;
- a pump for pumping contaminants from said tank to a receiving drum; and
- a piping manifold for connection between said suction hose and said pump and between said pump and said receiving drum, said manifold having a bypass valve for varying the rate of suction by said pump from said tank,
- said manifold further comprising a reversing valve for selectively reversing the direction of flow through said suction hose.

7. An apparatus for removing contaminants from an underground storage tank, comprising:
- a suction hose assembly, including
  - a guide tube for insertion into said underground tank,
  - a flexible hose for insertion through said guide tube into said tank, and
  - a hose reel for receiving and dispensing said hose;
- a positive displacement pump;
- a sediments receiving drum; and
- a piping manifold system, including
  - first suction and discharge valves for connection to said pump,
  - a connector for connection to said suction hose assembly;
  - a second discharge valve for connection to a discharge line terminating in said receiving drum;
  - a startup suction valve for controllably connecting said receiving drum to an inlet of said pump,
  - a bypass valve for adjusting the rate of removal of contaminants from said underground tank, a four-way valve for selectively reversing flow produced by said pump, and a sample tube for extracting fluid samples.

8. A system for removing bottom sediments and water from a hydrocarbon storage tank, comprising:

a receiving tank;

a flexible suction line having a suction end and a discharge end adapted at said suction end to be lowered to the bottom of said storage tank;

a positive displacement pump having a suction and a discharge;

a first flow line connecting said discharge end of said flexible line to said suction of said pump;

a second flow line connected at a first end to said discharge of said pump and opening at its second end into said receiving tank;

a start up flow line connected at a first end to said first flow line and opening at a second end into said receiving tank;

a valve in said startup flow line; and switching means for disconnecting said first flow line from said pump suction and connecting said first flow line to said pump discharge and for disconnecting said second flow line from said pump discharge and connecting said second flow line to said pump suction.

9. The system of claim 8 including a reel for reeling said flexible line into and out of said storage tank.

10. The system of claim 8 including a sight glass in said flexible line.

11. The system of claim 8 including a guide tube in said storage tank to receive and guide said flexible line into said storage tank and along the bottom of said storage tank.

12. A system for removing bottom sediments and water from a hydrocarbon storage tank, comprising:

a receiving tank;

a flexible suction line having a suction end and a discharge end adapted at said suction end to be lowered to the bottom of said storage tank;

a positive displacement pump having a suction and a discharge;

a first flow line connecting said discharge end of said flexible line to said suction of said pump;

a second flow line connected at a first end to said discharge of said pump and opening at its second end into said receiving tank;

a start up flow line connected at a first end to said first flow line and opening at a second end into said receiving tank;

a valve in said startup flow line; and a four-way valve in said first and second flow lines which in a first position provides a first flow path from said flexible line through said first flow line to said suction of said pump, and a second flow path from said discharge of said pump through said second flow line to said receiving tank; and in a second position provides an alternate first flow path from said receiving tank to said suction of said pump and an alternate second flow path from said discharge of said pump through said second flow line to said flexible line.

13. A system for removing bottom sediment and water from a hydrocarbon storage tank, comprising:

a first flow line having a first end and a second end and adapted at said first end to be lowered to the bottom of said storage tank;

a receiving tank;

a second flow line having first and second ends, said first end extending near the bottom of said receiving tank;

a flow loop, including a positive displacement pump, a suction line having first and second ends and attached at its second end to the suction of said pump, and a discharge line including first and second ends and attached at its said first end to the discharge of said pump; and a two-position, four-way valve connected to said loop and said second ends of said first and second flow lines such that said valve in a first position establishes flow between said second end of said first flow line and said first end of said suction line, and between said second end of said discharge line and said second end of said second flow line, and such that said valve in a second position establishes flow between said second end of said first flow line and said second end of said discharge line, and between said first end of said suction line and said second end of said second flow line.

14. The system of claim 13, further comprising:

a startup flow line having first and second ends, said first end near the bottom of said receiving tank and said second end connected to said suction line between said four-way valve and said pump; and a startup control valve in said startup flow line.

15. The system of claim 13, further comprising:

a bypass flow line having first and second ends, said first end connected to said discharge line between said pump and said four-way valve, and said second end connected to said suction line between said four-way valve and said pump; and a bypass control valve in said bypass flow line.

16. A method for removing contaminants from an underground storage tank, comprising the steps of:

initiating fluid flow by pumping fluid from a receiving tank;

gradually closing a startup suction valve to increase a pumping vacuum and decrease fluid flow from said receiving tank;

pumping contaminants from said storage tank; and controllably adjusting the rate at which contaminants are pumped from said storage tank.

17. The method of claim 16, wherein a bypass valve is manipulated to controllably adjust the rate at which contaminants are pumped from said storage tank.

18. The method of claim 16, wherein said startup suction valve is manipulated to controllably adjust the rate at which contaminants are pumped from said storage tank.

19. The method of claim 16, wherein said pumping is accomplished using a positive displacement pump.

20. The method of claim 16, wherein the step of adjusting the rate comprises the step of controllably interconnecting the pump discharge and suction to regulate the rate at which contaminants are pumped from said storage tank.

21. A method for removing bottom sediments from an underground tank, comprising the steps of:

initiating fluid flow by pumping fluid from a receiving tank;

gradually closing a startup suction valve to increase a pumping vacuum and decrease fluid flow from said receiving tank;

pumping bottom sediments from said underground tank through a suction conduit;

controllably interconnecting a discharge and a suction of said pump to regulate the rate at which bottom sediments are pumped from said underground tank; and selectively reversing the flow through said suction conduit.

* * * * *